US005280331A

United States Patent [19]

Namiki

[11] Patent Number: 5,280,331

[45] Date of Patent: Jan. 18, 1994

[54] IMAGE FORMING APPARATUS WITH BOTH-SURFACE FRAME INCLUDING A RETRACTABLE RE-FEEDING PATH UNIT

[75] Inventor: Hiroaki Namiki, Yokosuka, Japan

[73] Assignee: Canon Kabushiki Kaisha, Tokyo, Japan

[21] Appl. No.: 654,190

[22] Filed: Feb. 12, 1991

[30] Foreign Application Priority Data

Feb. 13, 1990 [JP] Japan ..... 2-31902
May 23, 1990 [JP] Japan ..... 2-134979

[51] Int. Cl.[5] ..... G03G 21/00

[52] U.S. Cl. ..... 355/318; 271/186; 355/319

[58] Field of Search ..... 271/902, 225, 184, 3.1, 271/258, 186, 291; 355/308, 309, 319, 321, 317, 324

[56] References Cited

U.S. PATENT DOCUMENTS 4,573,789 3/1986 Wada ..... 355/319
4,607,942 8/1986 Koyama et al. ..... 271/3.1 X
4,708,462 11/1987 Stemmle ..... 355/24
4,724,460 2/1988 Shinyashiki ..... 355/319
4,835,567 5/1989 Ogata ..... 355/318
4,855,787 8/1989 Hashimoto et al. ..... 355/24 X
4,905,053 2/1990 Matsuo et al. ..... 355/319
4,928,150 5/1990 Hatta ..... 355/319 X
4,935,786 6/1990 Veeder ..... 355/319
4,949,134 8/1990 Iwaki et al. ..... 355/319 X
4,975,738 12/1990 Senma et al. ..... 355/24 X

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus has an image forming device, a supplying path for supplying a sheet to the image forming device, a conveying path for conveying the sheet on which an image is formed by the image forming device means, and a re-feeding path branched from the conveying path and adapted to direct the sheet to the image forming device again. The image forming apparatus also has a both-surface frame including the re-feeding path and removably mounted on a body of the apparatus, and a reversing unit including a longitudinal substantially vertical path connecting the conveying path to the re-feeding path and pivotally mounted on the both-surface frame.

22 Claims, 16 Drawing Sheets

IMAGE FORMING APPARATUS WITH BOTH-SURFACE FRAME INCLUDING A RETRACTABLE RE-FEEDING PATH UNIT

BACKGROUND OF THE INVENTION

1. Field of the Invention

The present invention relates to an image forming apparatus having a re-feeding path, and more particularly it relates to an image forming apparatus capable of permitting both-surface recording operation.

2. Background Art

An example of a conventional image forming apparatus having the both-surface recording function is shown in FIG. 1. In FIG. 1, a sheet containing cassette 3 containing a plurality of recording sheets S is removably mounted on a body 2 of an image forming apparatus A. A sheet supply roller 5, and a separating pad 6 urged against the supply roller 5 and adapted to separate the sheets S are disposed at a downstream side of the cassette 3. Further, a pair of upper and lower regist rollers 7 and an image bearing member 9 are disposed in order at a downstream side of the supply roller 5. A scanner unit 10 serves to illuminate laser light onto the image bearing member 9 in response to the information from the outside, thereby forming a latent image.

A process cartridge 11 including the image bearing member 9 comprises various function portions for forming a toner image on the image bearing member 9 through a known electrophotographic process. An image transferring device 12 for transferring the toner image onto the sheet S is disposed below the image baring member 9, and a sheet conveying guide plate 13 and a fixing device 15 and the like are disposed in order at a downstream side of the image transferring device.

At a downstream side of the fixing device 15, there is disposed a sheet reversing unit 6 pivotably mounted on the body 2 via a support shaft 16*a*. The sheet reversing unit 16 includes a face-up ejector tray 17, a face-down-/both-surface switching flapper 19, a both-surface/face-up switching flapper 20, an ejecting path 21, a pair of reversing rollers 22, a reversing feeding path 25 and the like. Further, below a frame 26 of the body 2, there is disposed a re-feeding path 27 which includes an inlet guide 29 connected to a downstream end of the reversing feeding path 25, inlet conveying rollers 30, a lateral regist guide member 31, re-feeding rollers 32, a re-feeding path 33 and the like.

After the toner image is transferred from the image bearing member 9 onto the sheet S supplied from the sheet containing cassette 3 by means of the sheet supply roller 5, the toner image is fixed on the sheet by means of the fixing device 15.

When the both-surface recording operation is performed regarding the sheet S, the latter is directed to the sheet reversing unit 16 via the two flappers 19 and 20. After the both-surface/face-up switching flapper 20 is switched or changed to a both-surface recording mode, the switching operation of the face-down/both-surface switching flapper 19 is permitted.

When a trailing end of the sheet S ejected by the reversing rollers 22 rotated in directions shown by the arrows is detected by a reversing sensor 35, the sheet is sent to the reversing feeding path 25 by rotating the reversing rollers 22 in reverse directions and then is conveyed to the lateral regist guide member 31 by means of the inlet conveying rollers 30. A new toner image is transferred onto a back surface of the sheet S re-fed from the lateral regist guide member 31 by the re-feeding rollers 32, thus completing the both-surface recording.

FIG. 2 shows another example of a conventional image forming apparatus B having the both-surface recording function. In FIG. 2, the arrangement from the sheet containing cassette 3 to the fixing device 15 is the same as that of the apparatus shown in FIG. 1.

An ejection/both-surface switching flapper 37 is disposed at a downstream side of the fixing device 15, and intermediate rollers 39, upper ejecting rollers 40, an ejector tray 41 and the like are disposed in order above the flapper 37.

Further, at a lower both-surface sheet re-feeding area, there is arranged an introduction feeding path 49 including an introduction guide plate 42, a flapper 42*a* inlet conveying rollers 43, a conveying guide plate 45, a reversing sensor 46 and outlet conveying rollers 47. In addition, a reversing guide is protruded from the body 2 of the apparatus B. A re-feeding path 56 is constituted by the reversing guide 50, a lateral regist guide plate 51, a pair of sheet re-supply rollers 52, a flapper 53, a re-feeding guide 55 and the like.

When the both-surface recording is performed regarding the recording sheet S, the sheet S to a front surface of which the toner image was fixed by the fixing device 15 is conveyed onto the reversing guide 50 through the introduction guide plate 42 and the conveying guide plate 45. The sheet S re-fed by the paired re-supply rollers 52 is sent, through the re-feeding guide 55, to the image bearing member 9, where a new toner image is transferred onto a back surface of the sheet. Thereafter, the toner image is fixed on the back surface of the sheet by the fixing device 15, thus finishing the both-surface recording operation.

However, in the conventional image forming apparatus A shown in FIG. 1, although the sheet reversing unit 16 has the face-up rejecting elements such as the face-up ejector tray 17 and the like, since an ejecting angle of the sheet S on which the toner images were fixed is limited, the sheet reversing unit 16 inevitably protrudes rearwardly from the body 2 of the apparatus greatly.

In this case, when the both-surface recording mode is selected, since the sheet S having one surface on which the toner image was recorded is conveyed until a trailing end of the sheet is detected by the reversing sensor 35, a leading end of the sheet further protrudes from the rear end of the sheet reversing unit 16 rearwardly, thus causing a problem that a large installation space is required for installing the image forming apparatus A.

Further, if the sheet is jammed in the reversing feeding path 25 or the re-feeding path 27, since the sheet reversing unit 16 itself protrudes rearwardly, it is very difficult to remove the jammed sheet by swinging the sheet reversing unit 16 around the support shaft 16*a*. Thus, a maintenance space 56*a* must be provided for permitting the removal of the jammed sheet from the rear side of the apparatus, thereby making the compactness of the apparatus difficult.

On the other hand, in the conventional image forming apparatus B shown in FIG. 2, particularly when the fixing device 15 performs a heat or thermal fixing process, since the sheet S passed through the fixing device 15 is curled, the feeding path must be straight as much as possible, or, if the feeding path is curved, a radius of the curvature of the path must be great. In this respect, in the image forming apparatus B, the jamming of the sheet is difficult to occur in the both-surface sheet re-feeding portion; however, since the reversing guide 50 protrudes from the body 2 of the apparatus, it is also difficult to make the apparatus small-sized, like to the aforementioned conventional image forming apparatus A.

Further, in both of the above-mentioned image forming apparatuses A and B, since there are many limitations such as the mechanical accuracy of the both-surface feeding mechanism regarding the body 2, the reliability of connections such as the electrical connection between the both-surface feeding mechanism and the apparatus, the safety in the attachment of the both-surface feeding mechanism and an appearance treatment, and since the attachment of the both-surface feeding mechanism is very troublesome, it was practice to manufacture such image forming apparatuses by the makers. Therefore, there arose problems that the maintenance such as maintenance/inspection, replacement of parts and/or repair in the sheet reversing portion and the both-surface sheet feeding portion was worsened, and two inconsistent requirements (compactness of the apparatus and the wider jam treatment space regarding the jam treatment) had to be satisfied.

SUMMARY OF THE INVENTION

The present invention aims to eliminate the above-mentioned conventional drawbacks, and an object of the present invention is to provide an image forming apparatus which can be small-sized and has a sheet re-feeding path making a jam treatment easier.

In order to achieve the above object, according to the present invention, there is provided an image forming apparatus comprising a both-surface frame unit removably mounted on a body of the apparatus, and a reversing path unit adapted to reverse a feeding direction of a sheet and removably mounted on the body of the apparatus and extending substantially in a vertical direction.

The following advantages can be obtained by the present invention:

(1) Since the reversing (path) unit and a re-feeding (path) unit can be assembled independently from the body of the apparatus, the setting of a both-surface feeding mechanism relating to the both-surface recording becomes easier.

(2) Since the reversing(path) unit and the re-feeding (path) unit can be separated from the body of the apparatus, a user can replace or change the reversing (path) unit and/or the re-feeding (path) unit into another one by himself.

(3) Since the reversing (path) unit and the re-feeding (path) unit can be moved independently of the body of the apparatus, the jam treatment and/or maintenance in the reversing (path) unit and/or the re-feeding (path) unit become easier, and a one-surface recording operation can be effected even if the repair of the reversing (path) unit and/or the re-feeding (path) unit is required.

(4) By making the re-feeding (path), unit retractable with respect to the both-surface frame, there is need to provide the maintenance space which was inevitably provided for the jam treatment in the conventional apparatus, thus permitting the compactness of the image forming apparatus.

(5) Since the second sheet feeding path for directing the sheet to the re-feeding path is not needed to provide externally of the apparatus, the apparatus can be formed compactly; and since the guide for the second sheet feeding path can be formed on the frame of the apparatus, it is possible to easily perform the jam treatment by removing the frame to expose the second path. Further, by orienting the opening of the second sheet feeding path upwardly or toward the sheet ejecting direction, it is not needed to provide a room or space for reversing the sheet, thus considerably reducing the installation space for the apparatus.

DETAILED DESCRIPTION OF THE PREFERRED EMBODIMENTS

The present invention will now be explained in connection with embodiments thereof with reference to the accompanying drawings.

Figure 1:
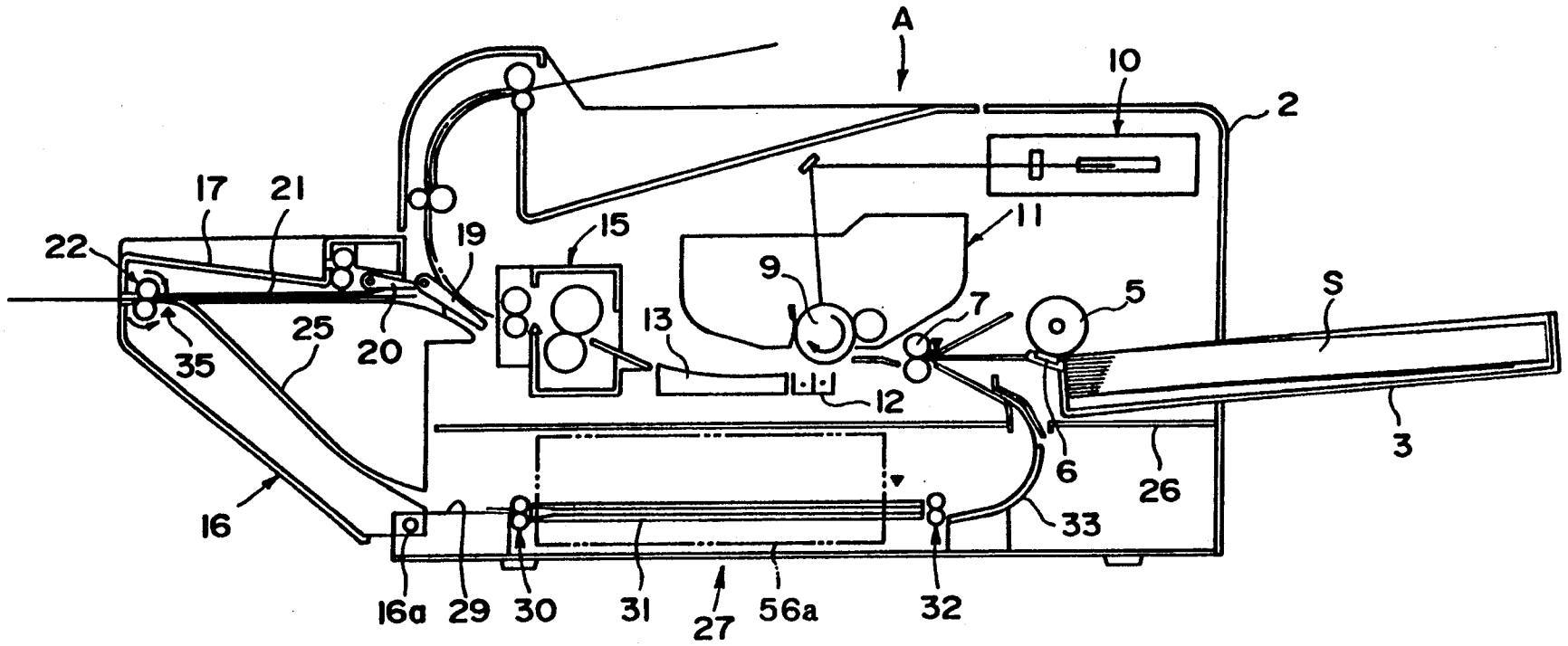
FIG. 1 PRIOR ART
FIG. 1 is an elevational sectional view showing an example of a conventional image forming apparatus.
Figure 2:
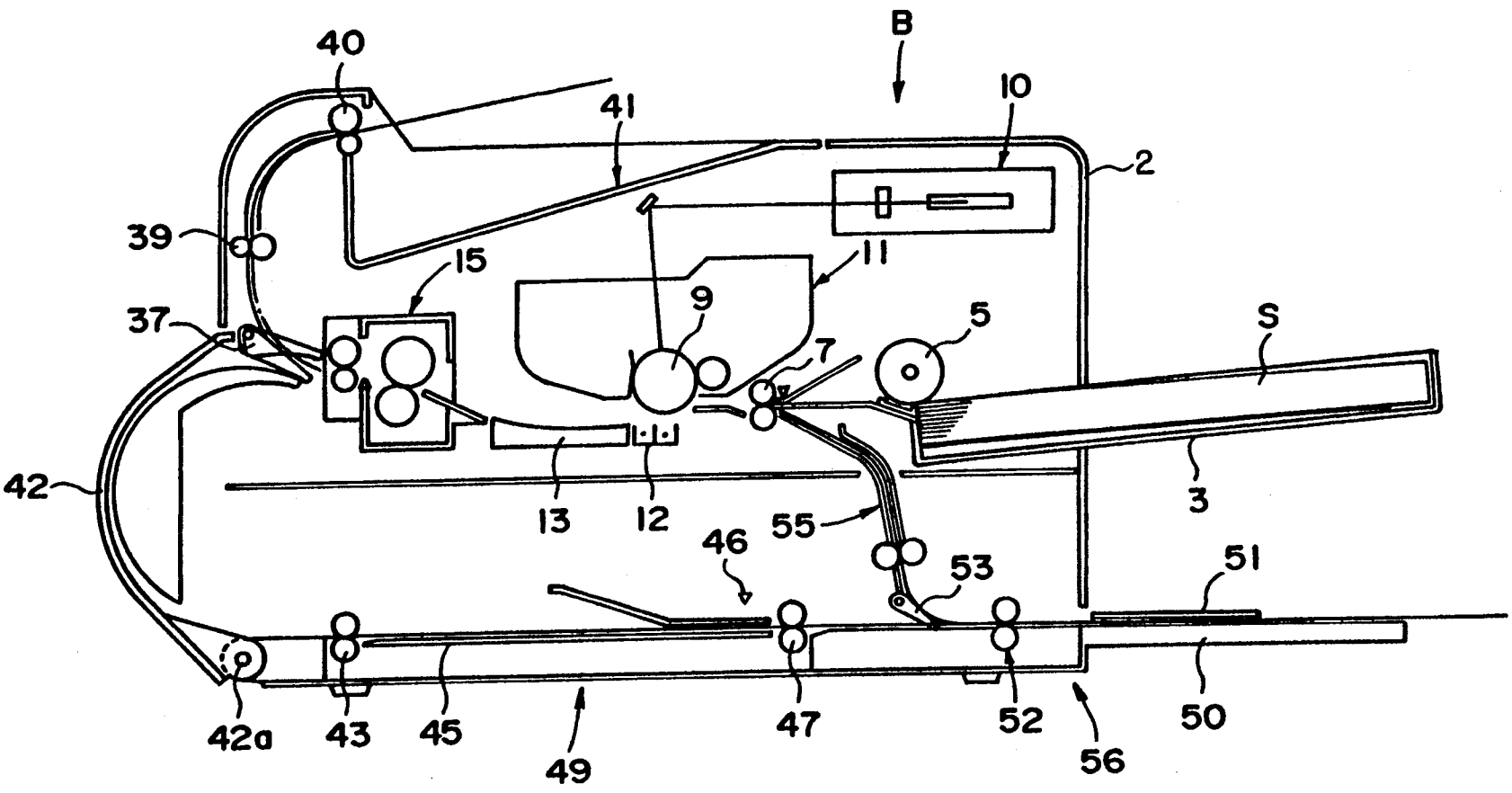
FIG. 2 PRIOR ART
FIG. 2 is an elevational sectional view of another conventional image forming apparatus.

Incidentally, in the embodiments of the present invention, the elements having the same constructions and functions as those shown in FIGS. 1 and 2 showing the conventional apparatuses will be designated by the same reference numerals.

Figure 3:
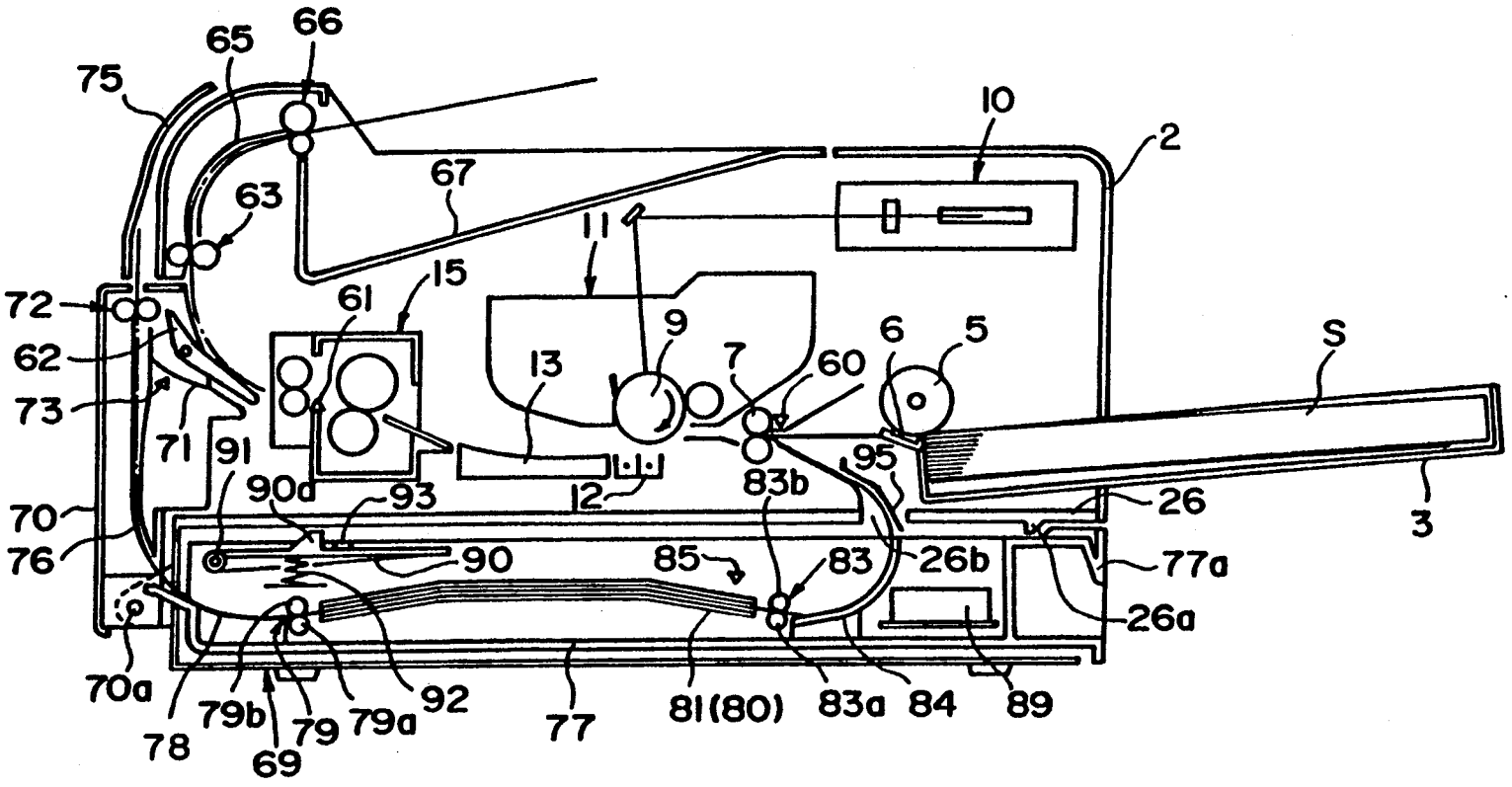
FIG. 3 is an elevational sectional view of an image forming apparatus according to a preferred embodiment of the present invention.
Figure 4:
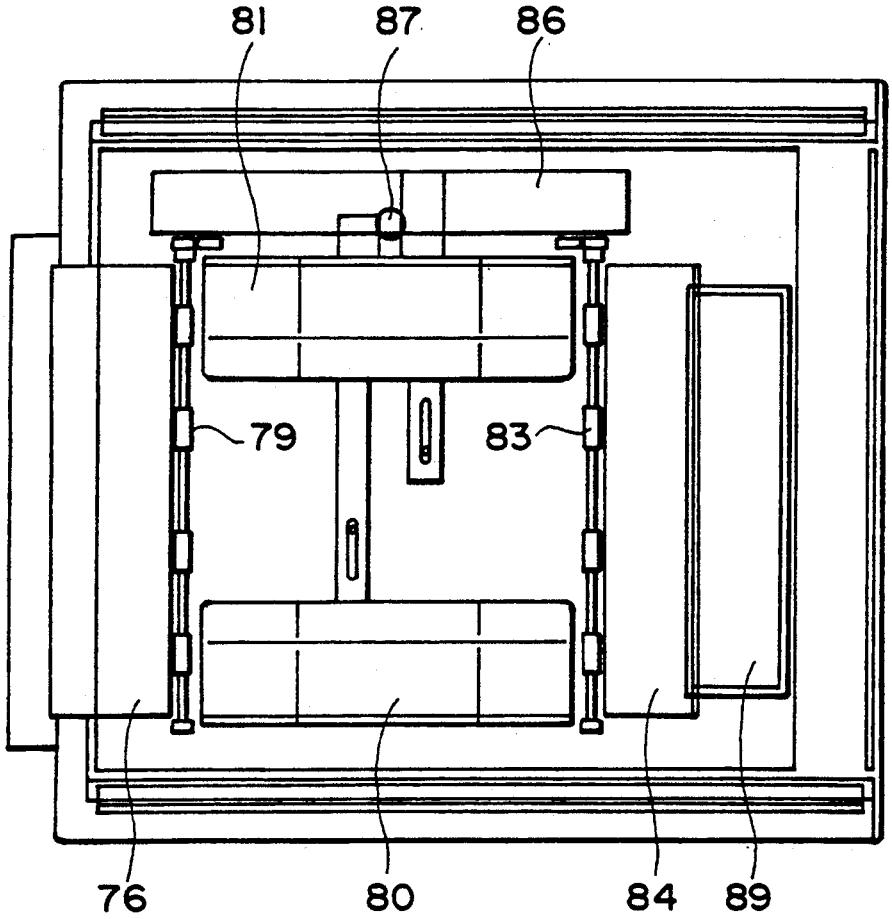
FIG. 4 is a plan view of the image forming apparatus shown in FIG. 3.

In FIG. 3, at an upstream side of regist rollers 7, there is disposed a pre-regist sensor 60 which serves to start the conveying operation of the sheet S separated one by one by means of a sheet supply roller 5 and a separating pad 6 in synchronous with the image formation on an image bearing member 9. At a downstream side of a fixing device 15, there is disposed a fixing and ejecting sensor 61 which serves to detect the sheet S after the fixing.

An ejecting/both-surface switching flapper (switching means) 62 is disposed at a downstream side of the fixing and ejecting sensor 61, and intermediate rollers 63, a curved sheet ejecting guide 65, ejecting rollers 66 and the like are disposed at a downstream side of the flapper 62. When the one-surface recording is designated, the recorded sheets S are sequentially ejected and stacked on an ejector tray 67 formed on an upper part of a body 2 of the image forming apparatus.

At a lower part of the apparatus body 2, a both-surface frame 69 containing a both-surface (treating) portion is mounted in a manner described later, and a base of a reversing unit 70 is rotatably (i.e., openable and closable) mounted, via a pivot 70*a*, on a rear (left in FIG. 3) part of the body 2. In a condition that the reversing unit 70 is positioned in a closed position as shown in FIG. 3, a reversing introduction guide 71 and a pair of reversing rollers (reversing rotary means) 72 are positioned in order at a downstream side of the ejecting/both-surface switching flapper 62, and a reversing sensor 73 is disposed in the reversing introduction guide 71. A reversing guide 75 is integrally or removably mounted on the reversing unit 70 above or at a downstream side of the paired reversing rollers 72.

Further, at a downstream side of the reversing guide 75 and below the pair of reversing rollers 72, there is formed a reversing feeding path 76 which serves to direct the sheet S from the reversing guide 75 to the both-surface frame 69. A re-feeding unit 77 is arranged within the both-surface frame 69. The re-feeding unit 77 is retractably mounted within the both-surface frame 69, the insertion and retraction of the unit 77 with respect to the frame 69 being effected by shifting the former along rails 69*a* (see FIG. 5) formed on the both-surface frame 69 by applying the operator's pushing and pulling forces via a grip 77*a*.

Within the re-feeding unit 77, there is arranged a both-surface inlet guide member 78 for guiding the sheet S from the reversing feeding path 76, and a first conveying roller pair 79 comprising a conveying roller 79*a* and a pressure roller 79*b* capable of engaging with and disengaging from the conveying roller, a pair of left and right lateral regist regulating guides 80, 81, a second conveying roller pair 83 comprising a conveying roller 83*a* and a pressure roller 83*b* capable of engaging with and disengaging from the conveying roller, a sheet re-feeding guide member 84 for guiding the sheet S in the re-feeding unit 77 toward the inside of the above apparatus body 2 and the like are arranged at a downstream side of the inlet guide 78 in order along a feeding direction of the sheet S. Further, a sheet detecting sensor 85 for detecting a leading end of the sheet S is disposed at a downstream side of the lateral regist regulating guides 80, 81.

In addition, the re-feeding unit 77 includes a driving system 86 for driving the first and second conveying roller pairs 79, 83, a driving system 87 for driving the lateral regist regulating guides 80, 81 and a drive controlling system 89. At a rear part of the re-feeding unit 77, a retraction regulating lever 90 having an upper projection 90*a* is rotatably mounted, via a pivot 91, within the re-feeding unit 77, which lever 90 is biased in an anti-clockwise direction by means of a compression spring 92 having a lower end engaged by a fixed member, so that the lever 90 is urged against a stopper 93 formed on the re-feeding unit 77 to limit the rotation of the lever. Further, at a front part of a frame 26 of the body 2, there is formed a stopper 26*a* on a bottom surface of the frame, which stopper cooperates with the projection 90*a*. A slit 26*b* formed in the body frame 26 is communicated with a pair of sheet re-feeding guides 95 formed within the apparatus body 2.

Figure 7:
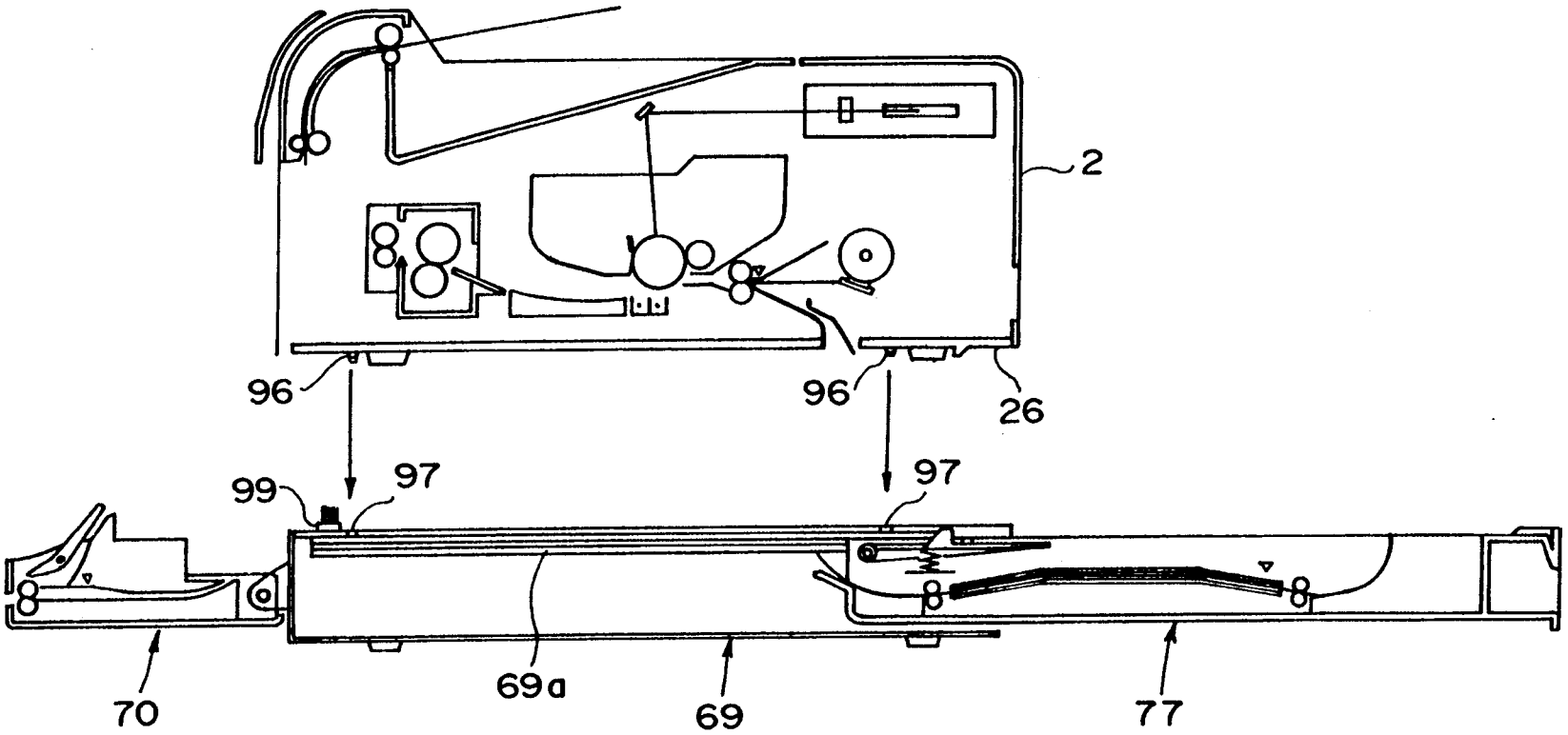
FIGS. 7 and 8 are elevational sectional views showing a connection portion between a both-surface frame and a body of the apparatus.
Figure 8:
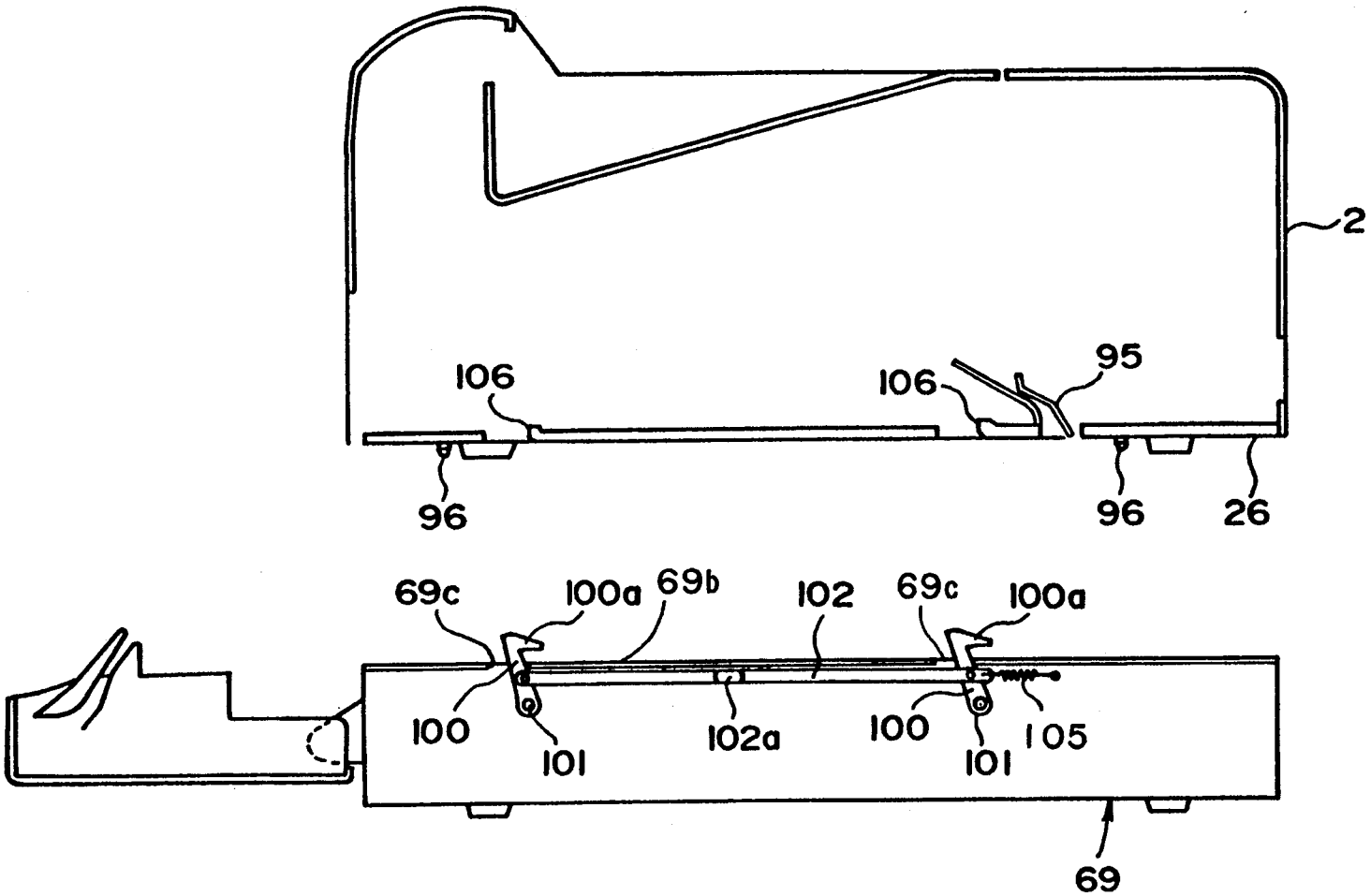
Figure 9:
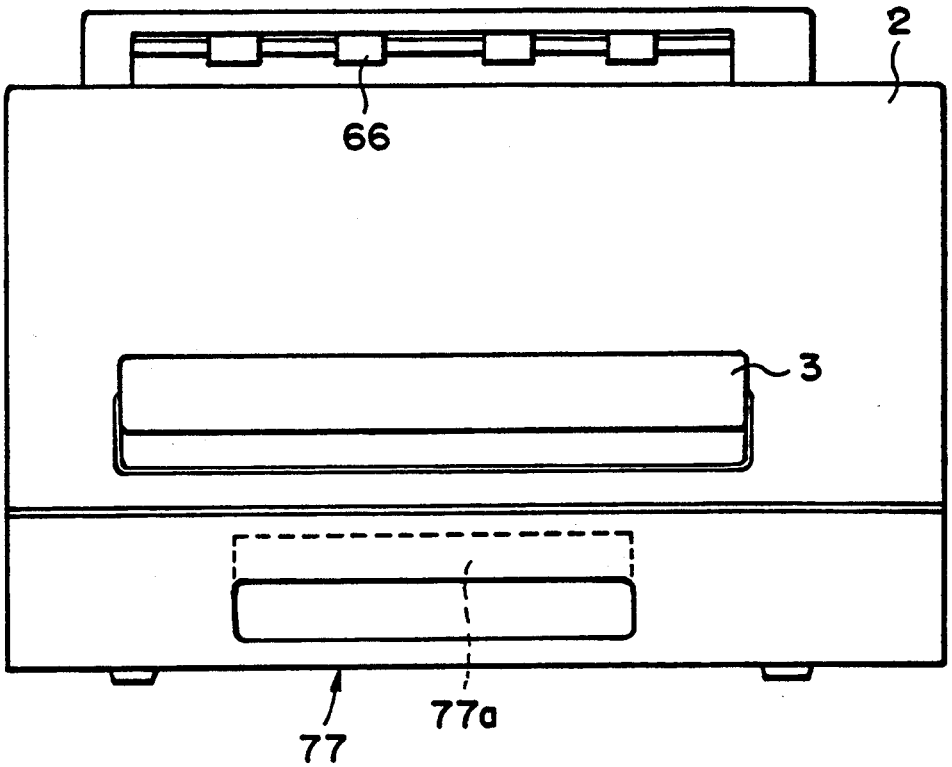
FIG. 9 is a side elevational view of the both-surface frame and the body of the apparatus after they are connected together.
Figure 10:
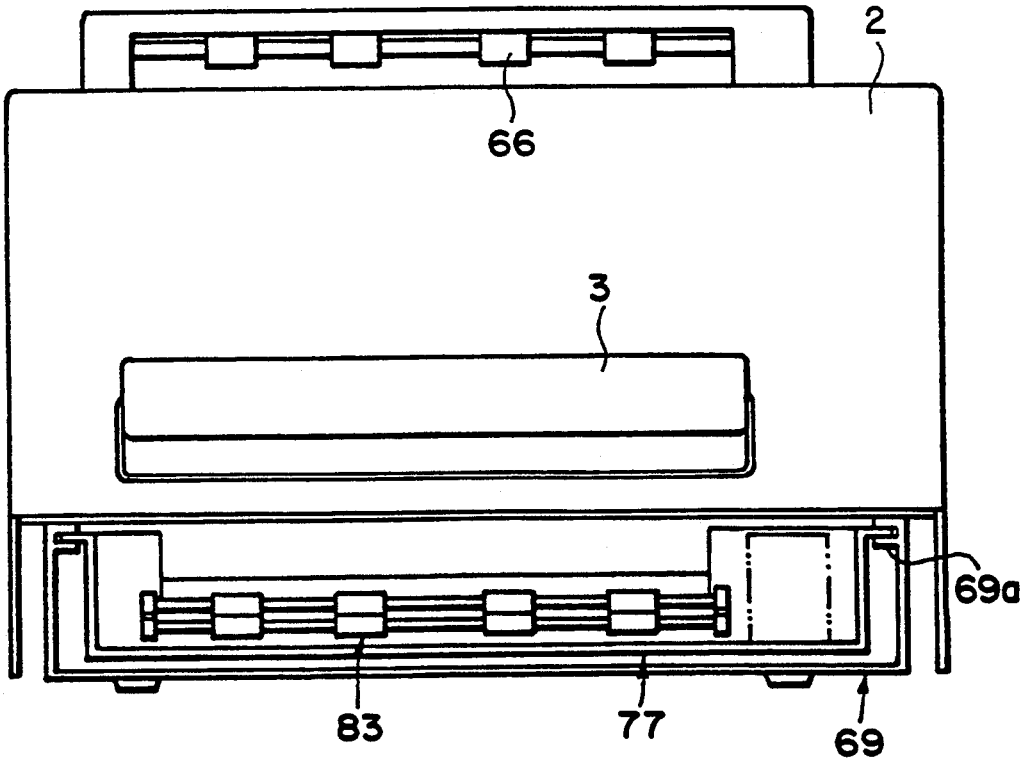
FIG. 10 is similar to FIG. 9, but showing in a partial section.

In FIGS. 7 and 8, a plurality of positioning projections 96 are formed on the body frame 26. By engaging these positioning projections 96 with corresponding positioning holes 97 formed in the re-feeding unit 77, the latter can be properly positioned with respect to the apparatus body 2. The both-surface unit 69 is electrically connected to the apparatus body 2 through a connector 99.

Further, as shown in FIG. 8, a pair of latches 100 each having an upper locking hook 100*a* are rotatably mounted, via respective pivots 101, on the both-surface frame 69 in such a manner that the hooks 100*a* are protruded upwardly through corresponding openings 69*c* formed in an upper plate 69*b* of the both-surface frame 69. Both latches 100 are connected to each other by a link 102 pivotally connected to the latches through respective pivots 101 so that both latches can be moved in synchronous with each other. The link 102 is biased forwardly by a tension spring 105 having one end fixed to the both-surface frame 69 so that sides of the latches 100 are abutted against side walls of the openings 69*c* to limit the rotation of the latches. Further, a plurality of engagement holes 106 with which the latches 100 can be engaged are formed in the frame 26 of the body 2.

Next, an operation of the apparatus so constructed will be explained.

After a toner image is transferred from the image bearing member 9 onto the sheet S supplied from a sheet containing cassette 3 by means of the supply roller 5, the toner image is fixed on the sheet by means of the fixing device 15. When the sheet S having one surface on which the toner image is fixed shields or blocks the fixing and ejecting sensor 61, the ejecting/both-surface switching flapper 62 is selectively switched. Now, when the both-surface recording is designated, the sheet S is directed, by the ejecting/both-surface switching flapper 62, toward the both-surface treating portion. Then, when the sheet blocks the reversing sensor 73, the rotational direction of the paired reversing rollers 72 and the switching timing are controlled to direct the sheet S toward the reversing guide 75.

By reversing the rotation of the reversing rollers 72 when the trailing end of the sheet S reaches a position just before the rollers 72, the sheet S is conveyed to the re-feeding unit 77 while being guided by the reversing conveying guide 76. The lateral regist regulating guides 80, 81 are held in a waiting position where they are spaced apart from each other by a distance greater than a maximum width of the sheet S, before the sheet is entered between these guides. After the sheet S having one surface on which the image is recorded enters between the lateral regist regulating guides 80, 81 by means of the first conveying roller pair 79 (now the pressure roller 79*a* being urged against the conveying roller 79*a*), the sheet blocks the sheet detecting sensor 85 and is further advanced by a predetermined distance ahead of the second conveying roller pair 83 and is stopped there.

Then, the first and second pressure rollers 79*b* and 83*b* are separated from the first and second conveying rollers 79*a* and 83*a*, respectively, by means of a driving mechanism (not shown) to leave the sheet S in a free condition. In this condition, the lateral regist regulating guides 80, 81 are approached to each other until they reach a predetermined sheet width position, thus performing the lateral registration of the sheet S. Then, the pressure rollers 79b and 83b are pressed against the conveying rollers 79a and 83a again. In this condition, by driving the first and second conveying roller pairs 79, 83, the sheet S is conveyed to the regist rollers 7. Thereafter, the image is recorded or printed on the back surface of the same sheet.

Figure 5:
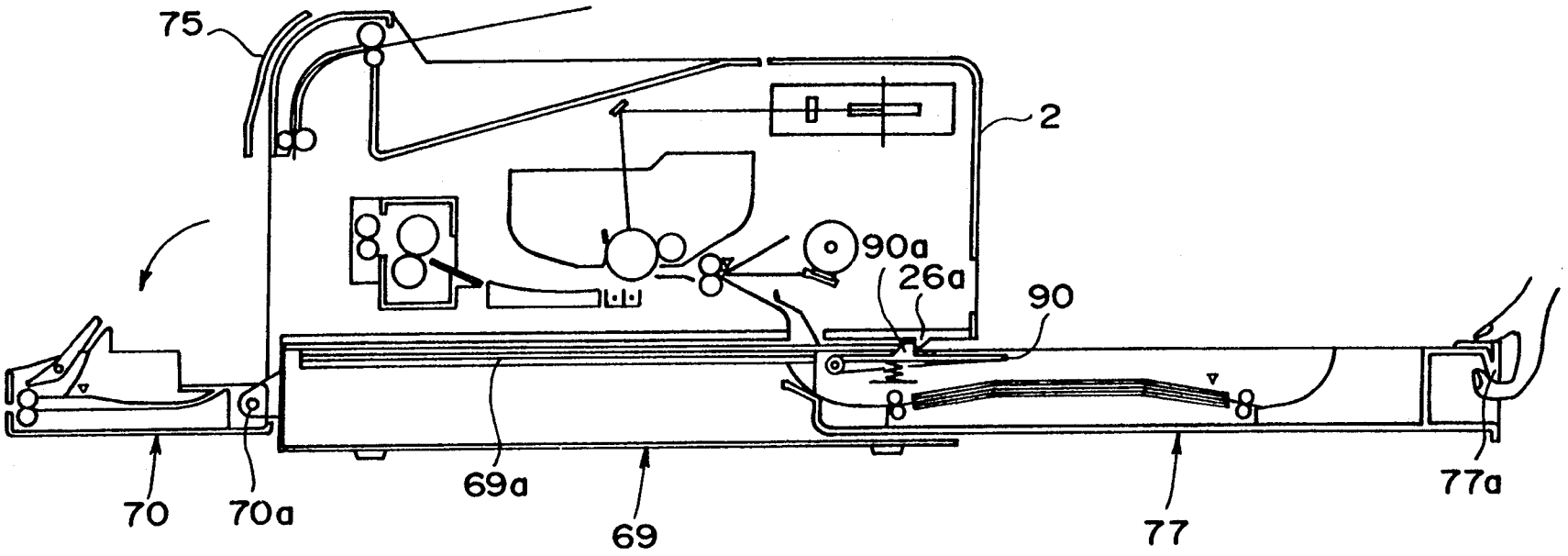
FIGS. 5 and 6 are elevational sectional views showing a reversing unit and a re-feeding unit in different conditions.

Incidentally, with this arrangement, since the reversing unit 70 is removably attached, at its upper portion, to the body 2 of the apparatus by means of latches (not shown), the reversing unit 70 can be opened toward a direction shown by the arrow by releasing the latches, as shown in FIG. 5. Further, the re-feeding unit 77 can be retracted from the both-surface frame 69 by pulling it along the rails 69a via the grip 77a, as shown in FIG. 5. During this retracting operation, when the re-feeding unit 77 is retracted by a predetermined amount, the projection 90a of the retraction regulating lever 90 is engaged by the stopper 26a of the body frame 26, thus preventing the further retraction of the re-feeding unit 77.

Figure 6:
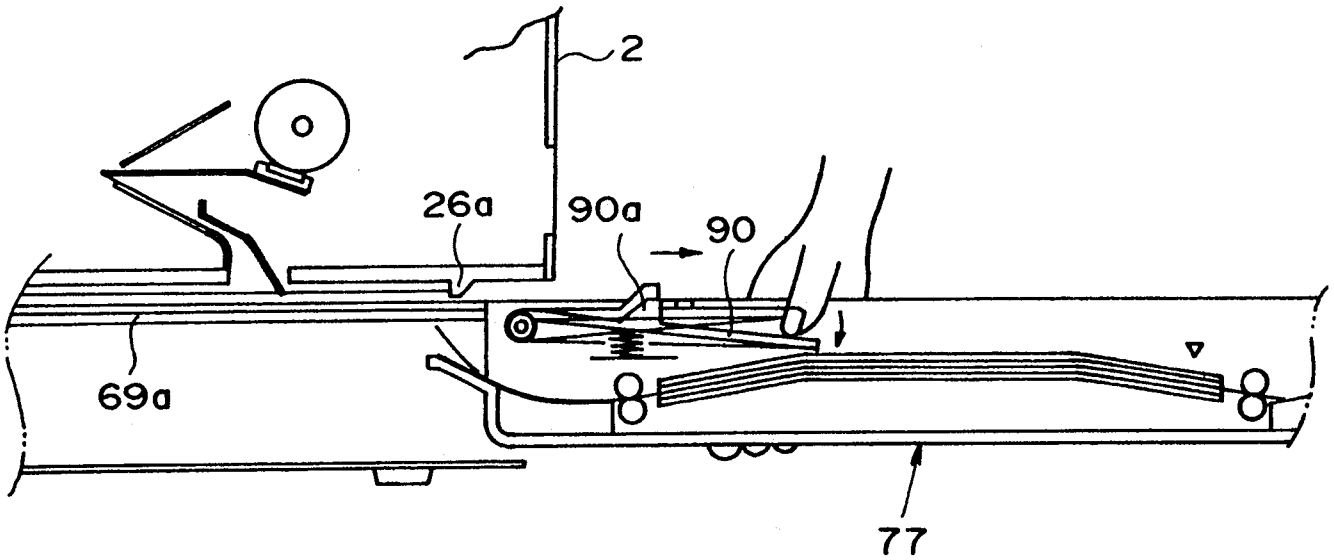

Furthermore, as shown in FIG. 6, when the retraction regulating lever 90 is pressed down by an operator, the projection 90a is disengaged from the stopper 26a, with the result that the re-feeding unit 77 can be completely removed from the both-surface frame 69. Further, as shown in FIGS. 7 and 8, by fitting the positioning projections 96 of the apparatus body 2 into the corresponding positioning holes 97 of the both-surface frame 69, the apparatus body 2 can be correctly positioned with respect to the both-surface frame 69, and, by engaging the latches 100 of the both-surface frame 69 with the engagement holes 106 of the body frame 26, the apparatus body 2 can be coupled to the both-surface frame 69. The releasing of the apparatus body from the both-surface frame is effected by shifting a grip 102a formed on the link 102 rearwardly, i.e., toward a release side.

As mentioned above, if the sheet is jammed in the both-surface treating portion, by opening the reversing unit 70 and retracting the re-feeding unit 77 from the both-surface frame 69 as shown in FIG. 7, the jammed sheet can easily be removed. Further, since the both-surface treating portion including the reversing unit 70, re-feeding unit 77 and both-surface frame 69 can be removed from the apparatus body 2, the both-surface image forming apparatus can easily be assembled by combining the apparatus body 2 and the both-surface frame 69 (which may be manufactured by different makers) and the maintenance such as the replacement of parts and/or the repair can be improved.

Next, a second embodiment of the present invention will be explained with reference to FIG. 11. Incidentally, the elements same as those shown in the previous first embodiment will be designated by the same reference numerals used in the first embodiment and the explanation thereof will be omitted.

Figure 11:
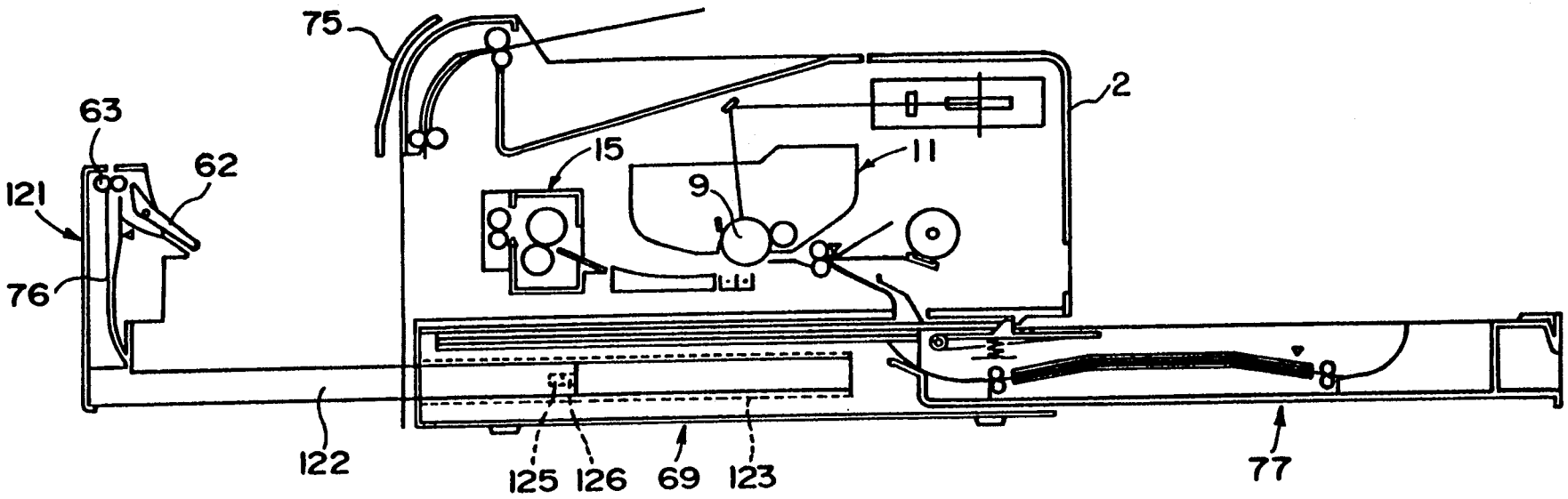
FIG. 11 is an elevational sectional view of an image forming apparatus according to a second embodiment of the present invention.

In FIG. 11, according to the second embodiment, a reversing unit 121 is provided at its lower part with a slider 122. A guide member 123 for slidably supporting the slider 122 and a stopper 125 for regulating the movement of the slider 122 are arranged within the both-surface frame 69. A projection 126 is formed on a free end of the slider 122. When the reversing unit 121 is retracted to a limit position as shown, the projection 126 abuts against the stopper 125, thus preventing the further retraction of the reversing unit 121. Further, similar to the first embodiment, the re-feeding unit 77 is retractable, as shown. In this way, by retracting the reversing unit and the re-feeding unit 77 from the apparatus body 2 as mentioned above, even if the sheet S is jammed in the both-surface treating portion, the jammed sheet can easily be removed and the maintenance can also easily be effected.

Next, a third embodiment of the present invention will be explained with reference to FIG. 12.

Figure 12:
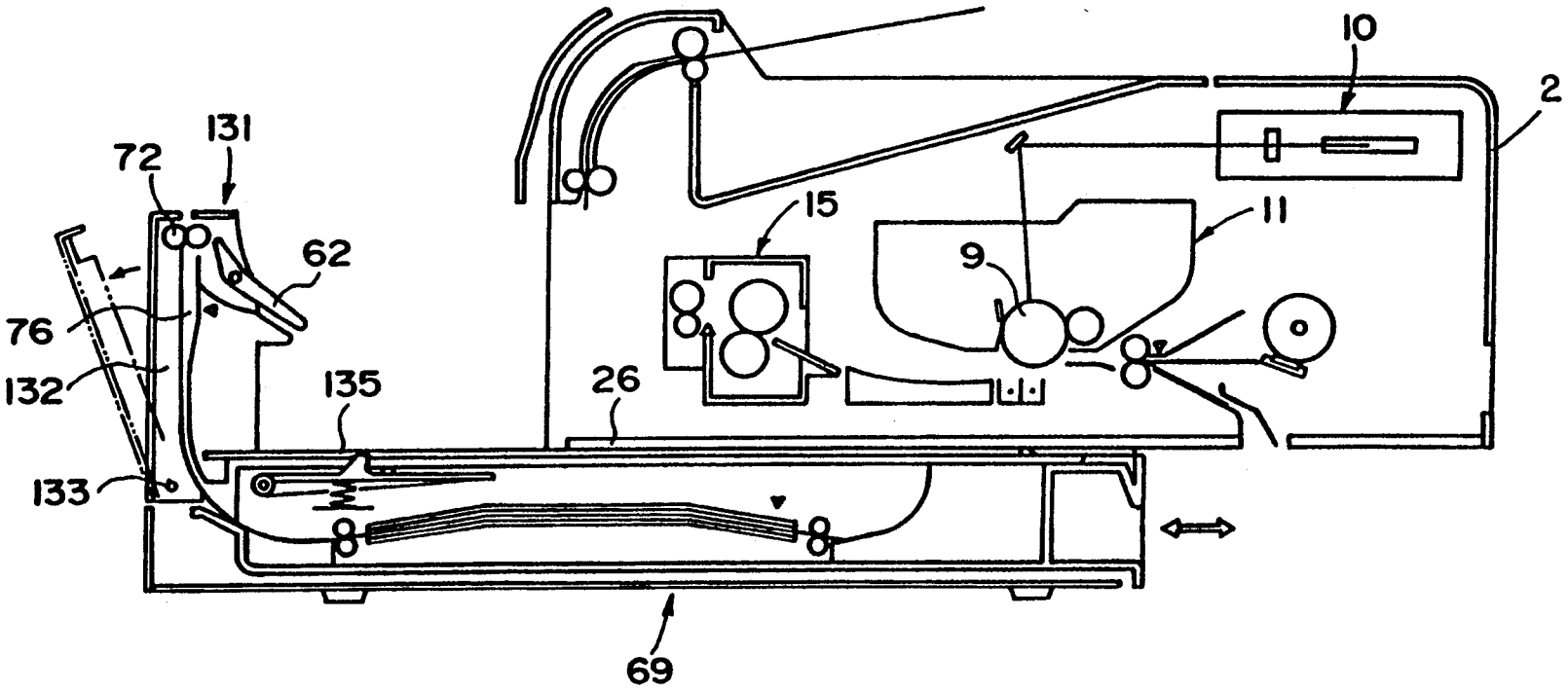
FIG. 12 is an elevational sectional view of an image forming apparatus according to a third embodiment of the present invention.

In FIG. 12, a reversing unit 131 including the ejecting/both-surface switching flapper 62, reversing roller pair 72 and the like is formed integrally with the both-surface frame 69. A guide plate 132 constituting the reversing conveying path 76 is arranged at a rear part of the reversing unit 131, and a base of the guide plate is pivotally mounted on the both-surface frame 69 via a pivot 133. Further, a slider 135 is disposed on the both-surface frame 69, which slider is slidably (in a front-and-rear direction) supported by the frame 26 of the body 2. With this arrangement, if the sheet S is jammed in the both-surface treating portion such as the reversing unit 131, both-surface frame 69 and the like, the jammed sheet can easily be removed and the maintenance can also easily be effected.

Figure 13:
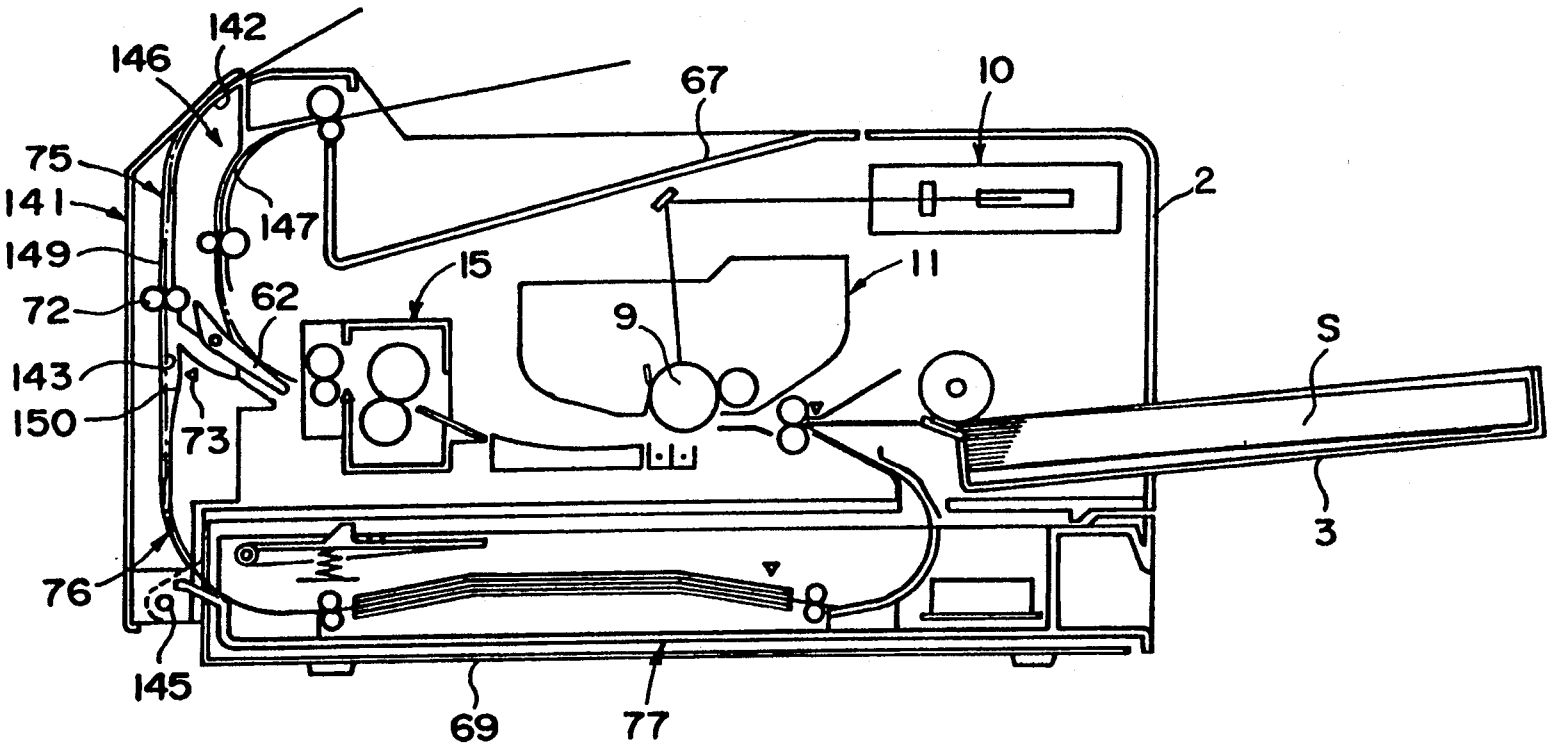
FIG. 13 is an elevational sectional view of an image forming apparatus according to a fourth embodiment of the present invention.
Figure 14:
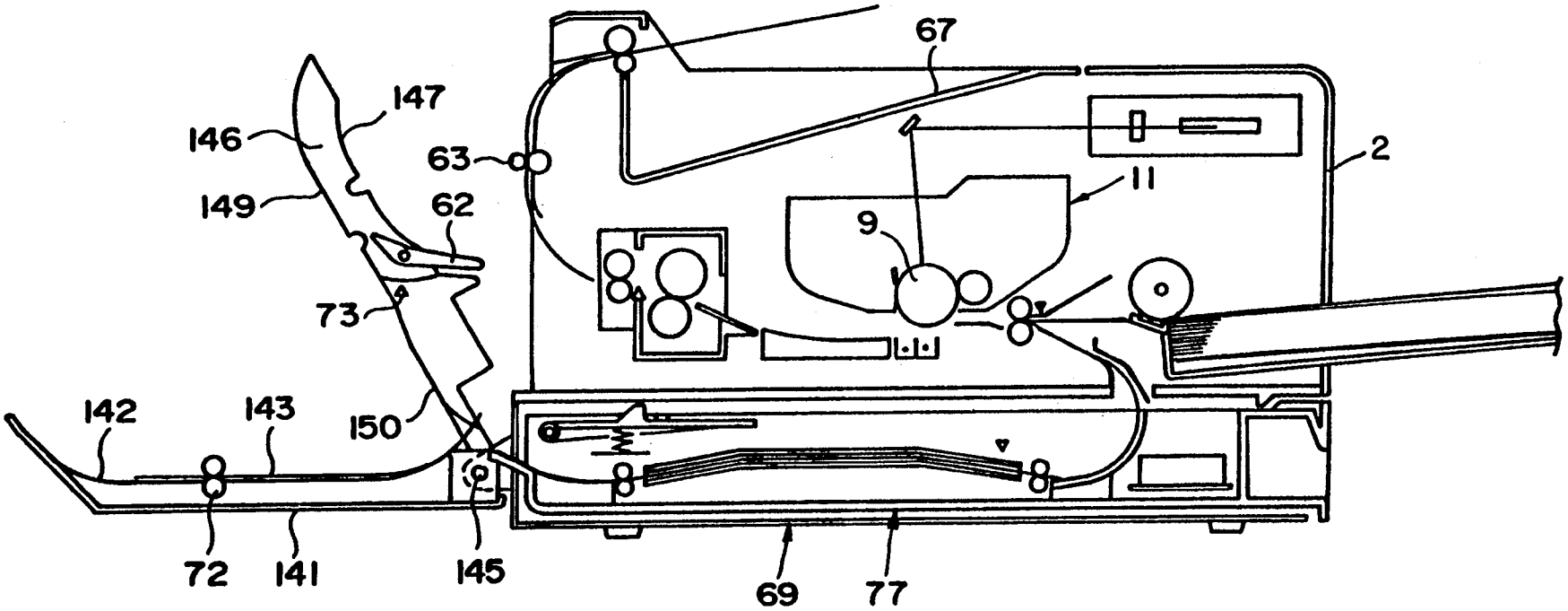
FIG. 14 is similar to FIG. 13, but showing an operative condition.

FIGS. 13 and 14 show a fourth embodiment of the present invention.

In FIGS. 13 and 14, a reversing unit 141 including the reversing roller pair 72 has a reversing guide 142 for forming a reversing introduction path and a guide surface 143 for forming the reversing conveying path 76, and is pivotally mounted, at its base portion, on the both-surface frame 69 via a pivot 145.

Further, a guide unit 146 includes the ejecting/both-surface switching flapper 62 and the reversing sensor 73, and is also pivotally mounted, at its base portion, on the both-surface frame 69 via the same pivot 145.

A side edge of the guide unit 146 confronting to the apparatus body 2 forms a sheet ejecting guide 147, and an opposite side edge (outer edge) of the guide unit forms a guide surface 149 of the reversing introduction path and a guide surface 150 of the reversing conveying path 76.

By selectively swinging either or both of the units 141, 146, since the ejecting path to the ejector tray 67 and/or the reversing introduction path and/or the reversing conveying path 76 to the re-feeding unit 77 can be opened or exposed, the jammed sheet S can more easily be removed.

Figure 16:
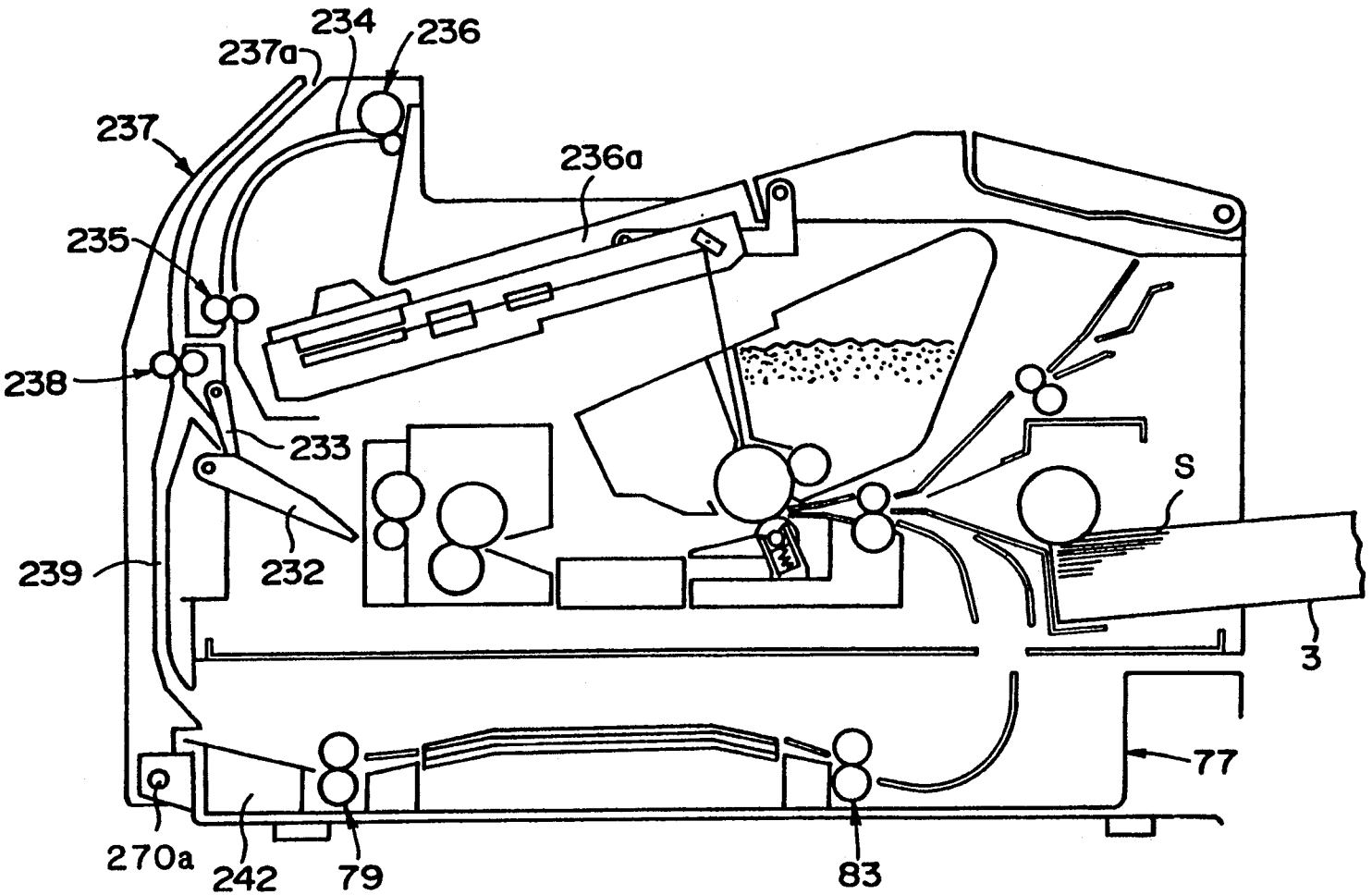
FIG. 16 is an elevational sectional view showing a first alteration of FIG. 15.
Figure 17:
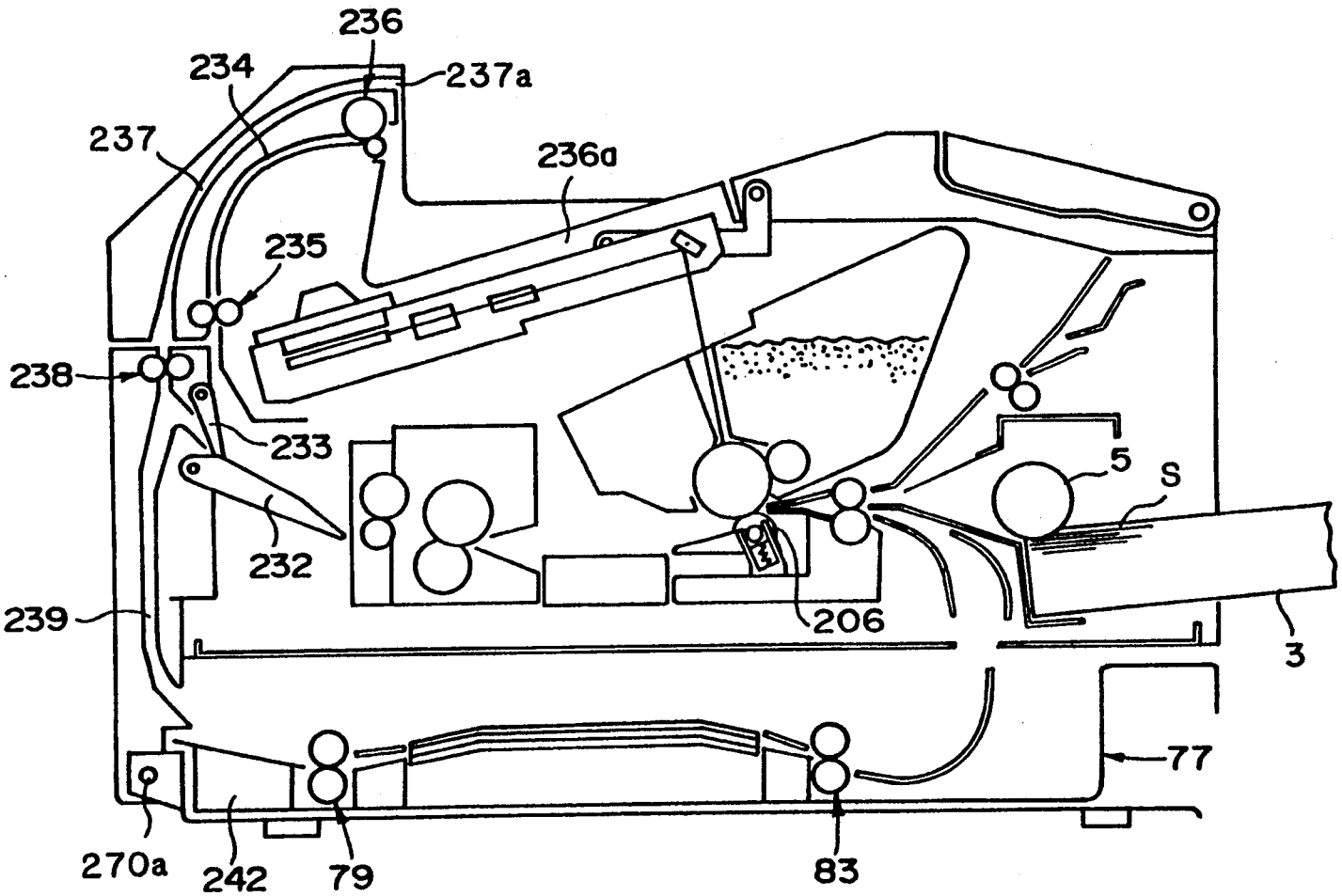
FIG. 17 is an elevational sectional view showing a second alteration of FIG. 15.

Next, a fifth embodiment of the present invention will be explained with reference to FIGS. 15 to 17. The elements same as those shown in FIG. 3 will be designated by the same reference numerals and the explanation thereof will be omitted.

Figure 15:
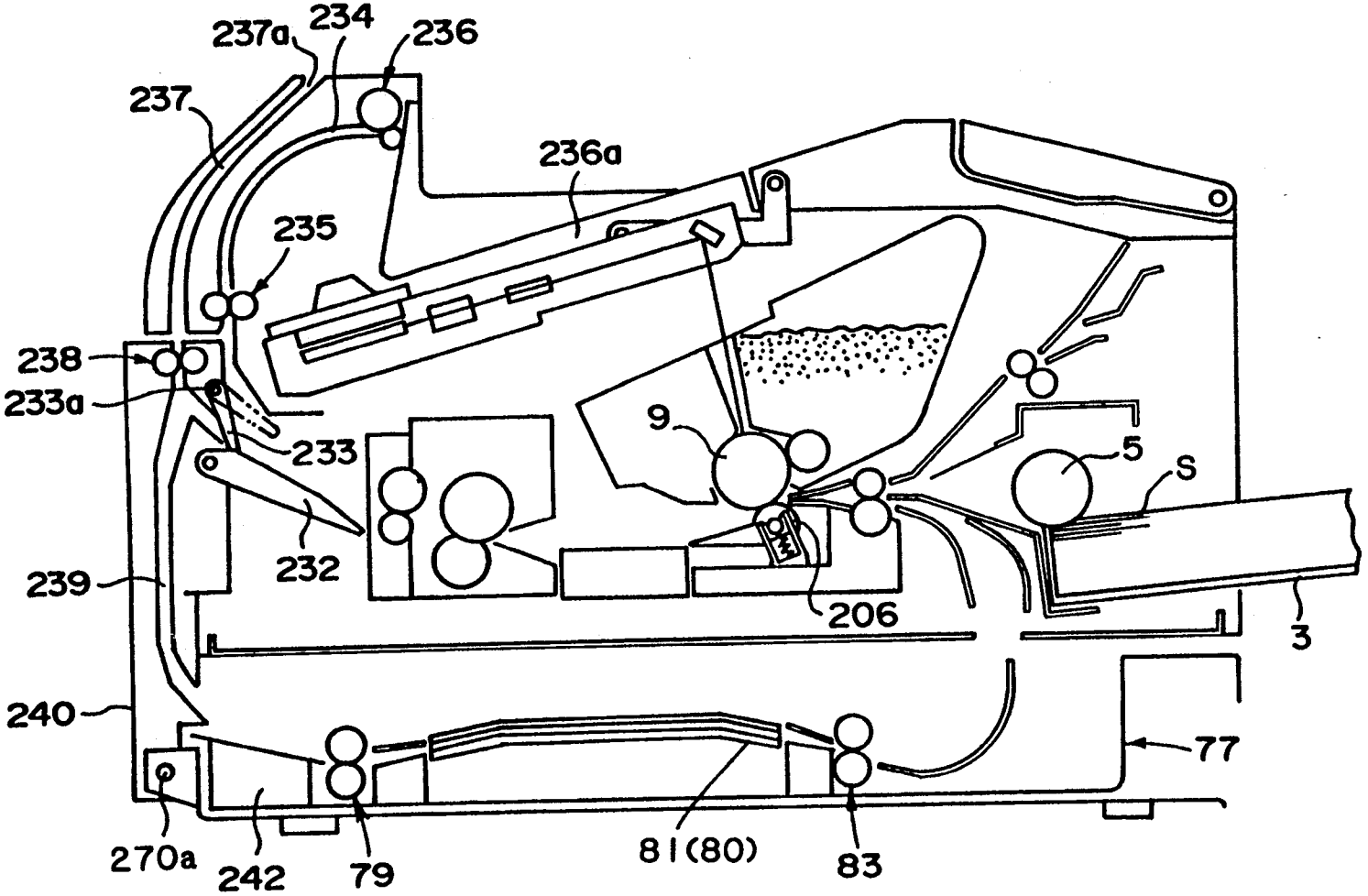
FIG. 15 is an elevational sectional view of an image forming apparatus according to a fifth embodiment of the present invention.

In FIG. 15, a reversing rollers 235 and a curved ejecting path 234 are arranged above a flappers 232, 233, and ejector rollers 236 are disposed at an outlet end of the ejecting path 234. An ejector tray 236a is formed on an upper surface of the apparatus body. Flapper 233 pivots about pivot 233a. The first sheet conveying path is constituted by a path extending from the sheet containing cassette 3 to the ejector tray.

Further, when the flapper is positioned in a condition shown by the two-dot and chain line, the second sheet conveying path is constituted by a path sandwiched between the flappers 232, 233, a reversing path 237 having an outlet opening 237a directed upwardly, and a conveying path 239 directed downwardly. Reversing rollers 238 are disposed in this second sheet conveying path.

Further, an inlet guide 242 is contiguous to the end of the conveying path 239, and the inlet conveying rollers 79, lateral regist guides 81(80), re-feeding rollers 83 and re-feeding guide path are arranged in the same manner as shown in FIG. 3. The re-feeding conveying path extends up to the regist rollers.

Next, an operation of this embodiment will be explained.

When the one-surface recording is selected, in a condition that the flappers 232, 233 are situated in the position shown by the solid line, the sheet S is sent to the ejecting path 234 by means of the conveying rollers 235 and then is ejected onto the ejector tray 236*a* by means of the ejecting rollers 236 with the recorded surface of the sheet turned downside.

When the both-surface recording is selected, the sheet S is introduced between the flapper 232 and the flapper 233 positioned in the two-dot and chain line position and then is sent upwardly through the reversing path 237 by means of the reversing rollers 238 until the leading end of the sheet S is protruded from the outlet opening 237*a* but the trailing end of the sheet approaches the reversing rollers 238. Then, the reversing rollers are rotated reversely to shift the sheet downwardly through the conveying path 239 (with the trailing end being ahead), and then, the sheet is sent to the lateral regist guides through the inlet guide 242 by means of the inlet conveying rollers 79. After the lateral edges of the sheet are regulated by the lateral regist regulating guides, the sheet S is sent to the regist rollers through the re-feeding guide plate by means of the re-feeding conveying rollers until the leading end of the sheet abuts against the regist rollers. Thereafter, the image is transferred from the image bearing member 9 by an image transferring device 206 onto the back surface of the sheet, and then, the sheet is sent, through the guide, to the fixing device where the image is fixed to the sheet. Then, the sheet is ejected onto the ejector tray 236*a* through the flappers 232, 233 (positioned in the solid lines) and the ejecting path 234 with the front surface of the sheet turned upside.

When the sheet is jammed, by swinging the reversing unit 240 with the flapper 232 around a pivot 270*a*, the jammed sheet can be removed.

Next, a first alteration of the FIG. 15 will be explained with reference to FIG. 16.

This alteration differs from the fifth embodiment of FIG. 15 in the point that an outer guide of the reversing path 237 and an outer guide of the conveying path 239 are integrally formed and this integral guide is pivotally mounted on the both-surface frame 69 via a pivot 270*a*. Thus, if the sheet is jammed in the reversing path 237 or the conveying path 239, the jammed sheet can easily be removed.

Next, a further alteration will be explained with reference to FIG. 17.

This second alteration differs from the fifth embodiment of FIG. 15 in the point that the reversing path 237 is curved along the ejecting path 234 so that the direction to which the sheet S is ejected is identical with the direction to which the sheet S is temporarily ejected out of the apparatus for the re-feeding operation. Further, in this case, the leading end of the sheet can face the ejector tray 236*a*.

What is claimed is:

1. An image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, comprising:

a both-surface frame including said re-feeding path and removably mounted on a body of the apparatus; and a reversing unit including a reverse path extending vertically for connecting said conveying path to said re-feeding path and openably mounted on said both-surface frame by a pivot, wherein said both-surface frame includes a re-feeding path unit which is retractable in a direction parallel to a sheet re-feeding direction in said re-feeding path unit with respect to said both-surface frame, and said reversing unit can be opened independently and said re-feeding path unit can be retracted independently.

2. An image forming apparatus according to claim 1, further comprising a tray disposed above said image forming apparatus to receive the sheet discharged.

3. An image forming apparatus according to claim 2, wherein said both-surface frame including an engagement means for limiting a retraction amount of said re-feeding path unit to a predetermined amount; and the limitation by said engagement means being released by a releasing lever means of said re-feeding path unit which releases engagement by depression of said releasing lever means.

4. An image forming apparatus according to claim 1, wherein said reversing unit includes a reversing rotary means for reversing a feeding direction of the sheet.

5. An image forming apparatus according to claim 4, wherein said both-surface frame is arranged at a bottom of said body of the apparatus.

6. An image forming apparatus according to claim 5, wherein said both-surface frame and said reversing unit are constituted to form an L-shaped configuration.

7. An image forming apparatus according to claim 1, wherein said reversing unit includes an ejecting path for directing the sheet to an ejector tray, and a means for selecting said ejecting path or said vertical path.

8. An image forming apparatus according to claim 7, wherein said ejecting path and said vertical path are exposed by opening said reversing unit.

9. An image forming apparatus according to claim 7, wherein at least a portion of said ejecting path is arranged side by side with respect to at least a portion of said vertical path.

10. An image forming apparatus according to claim 9, wherein said portion of said ejecting path arranged side by side is an ejecting outlet portion of said ejecting path, and said portion of said vertical path arranged side by side is a switch-back path portion of said vertical path.

11. A both-surface unit used with an image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, said both-surface unit comprising:

a both-surface frame including said re-feeding path and removably mounted on a body of the apparatus; and a reversing unit including a reverse path connecting said conveying path to said re-feeding path and openably mounted on said both-surface frame by a pivot, wherein said both-surface frame includes a re-feeding path unit which is retractable in a direction parallel to a sheet re-feeding direction in said re-feeding path unit with respect to said both-surface frame, and said reversing unit can be opened independently and said re-feeding path unit can be retracted independently.

12. A both-surface unit according to claim 11, wherein said reversing unit includes a reversing rotary means for reversing a feeding direction of the sheet.

13. A both-surface unit according to claim 12, wherein said both-surface frame is arranged at a bottom of said body of the apparatus.

14. A both-surface unit according to claim 13, wherein said both-surface frame and said reversing unit are constituted to form an L-shaped configuration.

15. An image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, comprising:

a both-surface frame including said re-feeding path and removably mounted on a body of the apparatus; and a reversing unit including a reverse path connecting said conveying path to said re-feeding path and slidably mounted on said both-surface frame, wherein said both-surface frame includes a re-feeding path unit which is retractable in a direction parallel to a sheet re-feeding direction in said re-feeding path unit with respect to said both-surface frame and said reversing unit can be slid independently and said re-feeding path unit can be retracted independently.

16. An image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, comprising:

a both-surface frame slidably supporting a body of the apparatus;

a re-feeding path unit including said re-feeding path and retractably supported by said both-surface frame; and a slider provided on said both-surface frame for guiding sliding of said body of said apparatus in the same direction as a re-feeding direction.

17. An image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, comprising:

a both-surface frame including said re-feeding path and slidably supporting a body of the apparatus; and a slider provided on said both-surface frame for guiding sliding of said body of said apparatus in the same direction as a re-feeding direction.

18. An image forming apparatus having an image forming means, a supplying path for supplying a sheet to said image forming means, a conveying path for conveying the sheet on which an image is formed by said image forming means, a tray disposed above said image forming apparatus to receive the sheet discharged and a re-feeding path branched from said conveying path and adapted to direct the sheet to said image forming means again, comprising:

a both-surface frame including said re-feeding path and slidably supporting a body of the apparatus, further including a reversing unit including a longitudinal substantially vertical path connecting said conveying path reached to said tray to said re-feeding path and openably mounted on said both-surface frame; and a slider provided on said both-surface frame for guiding sliding of said body of said apparatus in the same direction as a re-feeding direction.

19. A both-surface unit used with an image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, said both-surface unit comprising:

a both-surface frame slidably supporting a body of the apparatus;

a re-feeding path unit including said re-feeding path and retractably supported by said both-surface frame; and a slider provided on said both-surface frame for guiding sliding of said body of said apparatus in the same direction as a re-feeding direction.

20. An image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, comprising:

a both-surface frame removably mounted on a body of the apparatus; and a re-feeding path unit including said re-feeding path and retractably supported by said both-surface frame, wherein said both-surface frame includes an engagement means for limiting a retraction amount of said re-feeding path unit to a predetermined amount; and wherein the limitation of said engagement means is released by a releasing lever means of said re-feeding path unit which releases engagement by depression of said releasing lever means.

21. A both-surface unit used with an image forming apparatus having an image forming means, a supplying path for supplying a sheet to said image forming means, a conveying path for conveying the sheet on which an image is formed by said image forming means, and a re-feeding path branched from said conveying path and adapted to direct the sheet to said image forming means again, said both-surface unit comprising:

a both-surface frame including said re-feeding path and removably mounted on a body of the apparatus;

a reversing unit including a reverse path connecting said conveying path to said re-feeding path and slidably mounted on said both-surface frame, wherein said both-surface frame includes a re-feeding path unit which is retractable in a direction parallel to the re-feeding direction in said re-feeding unit with respect to said both-surface frame; and a slider provided on said both-surface frame for guiding sliding of said body of said apparatus in the same direction as the re-feeding direction.

22. An image forming apparatus having an image forming means, a supplying path for supplying a sheet to said image forming means, a conveying path for conveying the sheet on which an image is formed by said image forming means, a tray disposed above said image forming apparatus to receive the sheet discharged and a re-feeding path reached to said tray and branched from said conveying path and adapted to direct the sheet to said image forming means again, comprising:

a both-surface frame including said re-feeding path and removably mounted on a body of the apparatus;

a reversing unit including a longitudinal substantially vertical path connecting said conveying path to said re-feeding path and slidably mounted on said both-surface frame, wherein said both-surface frame includes a re-feeding path unit which is retractable in a direction parallel to the re-feeding direction in said re-feeding unit with respect to said both-surface frame; and a slider provided on said both-surface frame for guiding sliding of said body of said apparatus in the same direction as the re-feeding direction.

* * * * *

UNITED STATES PATENT AND TRADEMARK OFFICE

CERTIFICATE OF CORRECTION

PATENT NO. : 5,280,331
DATED : January 18, 1994
INVENTOR(S) : HIROAKI NAMIKI

It is certified that error appears in the above-indentified patent and that said Letters Patent is hereby corrected as shown below:

Title page, item [57],
ABSTRACT,
Line 5, "device means," should read --device,--.

Column 10,
Line 27, "including" should read --includes--.

Signed and Sealed this

Nineteenth Day of July, 1994

Bruce Lehman

*Attest:*

BRUCE LEHMAN

*Attesting Officer*

*Commissioner of Patents and Trademarks*